US010612284B1

(12) United States Patent
Johnson

(10) Patent No.: US 10,612,284 B1
(45) Date of Patent: Apr. 7, 2020

(54) HINGE PIN APPARATUS AND METHOD OF USE

(71) Applicant: Robert W. Johnson, Fort Worth, TX (US)

(72) Inventor: Robert W. Johnson, Fort Worth, TX (US)

( * ) Notice: Subject to any disclaimer, the term of this patent is extended or adjusted under 35 U.S.C. 154(b) by 0 days.

(21) Appl. No.: 15/993,898

(22) Filed: May 31, 2018

Related U.S. Application Data

(60) Provisional application No. 62/512,941, filed on May 31, 2017.

(51) Int. Cl.
*E05D 11/02* (2006.01)
*E05D 5/10* (2006.01)
*E05D 3/02* (2006.01)

(52) U.S. Cl.
CPC ..... *E05D 5/10* (2013.01); *E05D 3/02* (2013.01); *E05D 2005/102* (2013.01); *E05Y 2900/132* (2013.01)

(58) Field of Classification Search
CPC . Y10T 16/557; Y10T 16/5373; Y10T 16/537; E05D 5/10; E05D 3/02; E05D 2005/102; E05D 11/02; E05Y 2900/132; E05Y 2900/531
See application file for complete search history.

(56) References Cited

U.S. PATENT DOCUMENTS 1,168,568 A * 1/1916 Rudolff ..... E05D 11/02 16/274
1,673,459 A * 6/1928 Jurad ..... B60R 17/00 251/149.7
1,898,936 A * 2/1933 Brawley ..... E05D 11/02 16/274
2,053,864 A * 9/1936 Cook ..... E05D 11/02 16/274
2,570,942 A * 10/1951 Hadfield ..... E05D 11/02 16/274
3,407,903 A * 10/1968 Sansabrino ..... F16B 33/00 16/274
5,771,538 A * 6/1998 Huppert, Sr. ..... E05D 11/02 16/274
6,514,002 B1 * 2/2003 Katae ..... F16C 11/02 280/86.754
6,742,932 B2 * 6/2004 Eisenberg ..... F16C 33/6622 184/5.1

(Continued)

FOREIGN PATENT DOCUMENTS

DE 1924113 A1 * 11/1970 ..... B21K 1/44
DE 2547218 A1 * 5/1977 ..... B21K 1/46

OTHER PUBLICATIONS

English translation of DE 1924113 A1.*

*Primary Examiner* — Chuck Y Mah
(74) *Attorney, Agent, or Firm* — Eldredge Law Firm, LLC; Richard Eldredge; Beth Felix

(57) ABSTRACT

A hinge pin includes a pin body with an upper portion and a lower portion; a reservoir within the pin body and accessible from a top end of the body, the reservoir extending a length of the upper portion; a weep hole extending from an exterior of the pin body and into the reservoir at a base of the reservoir; and a cap removably secured to the pin body at the top end; the upper portion is shorter than the lower portion; and the reservoir is to receive a lubricant to disperse through the weep hole.

9 Claims, 6 Drawing Sheets

(56) References Cited

U.S. PATENT DOCUMENTS

| | | | | |
|---|---|---|---|---|
| 8,561,261 | B2 * | 10/2013 | Gibson | E05D 11/02 16/274 |
| 8,701,247 | B1 * | 4/2014 | Shargh | E05D 11/02 16/274 |
| 2012/0079683 | A1 * | 4/2012 | Spragg | E05D 11/02 16/274 |

* cited by examiner

HINGE PIN APPARATUS AND METHOD OF USE

BACKGROUND

1. Field of the Invention

The present invention relates generally to door hinge systems, and more specifically, to a hinge pin for easy and quick lubrication of a hinge.

2. Description of Related Art

Door hinge systems are well known in the art and are effective means to secure a door to a frame. For example, FIG. 1 depicts a conventional door hinge system 101 having a door 103 secured to a frame 105 via a hinge 107 with a hinge pin 109. During use, the hinge pin 109 is placed in hinge 107 while allowing rotation of the door.

One of the problems commonly associated with system 101 is lubrication. For example, it is common for the hinge system to become dry and noisy overtime, thereby requiring lubrication. The common practice involves either fully removing the pin to lubricate the system, which is inconvenient, or spraying a lubricant over the top of the hinge, which can be messy.

Accordingly, although great strides have been made in the area of door hinge systems, many shortcomings remain.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1:
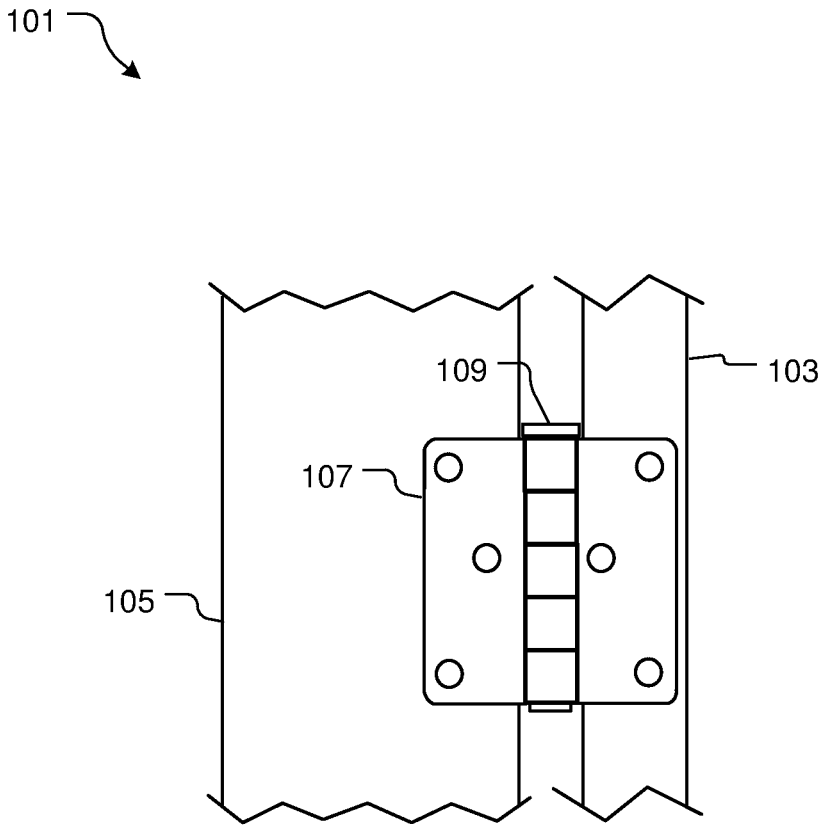
FIG. 1 (Prior Art)
FIG. 1 is a simplified front view of a common door hinge system.

While the system and method of use of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the system and method of use of the present application are provided below. It will of course be appreciated that in the development of any actual embodiment, numerous implementation-specific decisions will be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The system and method of use in accordance with the present application overcomes one or more of the above-discussed problems commonly associated with conventional door hinge systems. Specifically, the present invention provides a means to cleanly and conveniently lubricate the hinge system without removing the hinge pin. These and other unique features of the system and method of use are discussed below and illustrated in the accompanying drawings.

The system and method of use will be understood, both as to its structure and operation, from the accompanying drawings, taken in conjunction with the accompanying description. Several embodiments of the system are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless described otherwise.

The preferred embodiment herein described is not intended to be exhaustive or to limit the invention to the precise form disclosed. It is chosen and described to explain the principles of the invention and its application and practical use to enable others skilled in the art to follow its teachings.

Figure 2A:
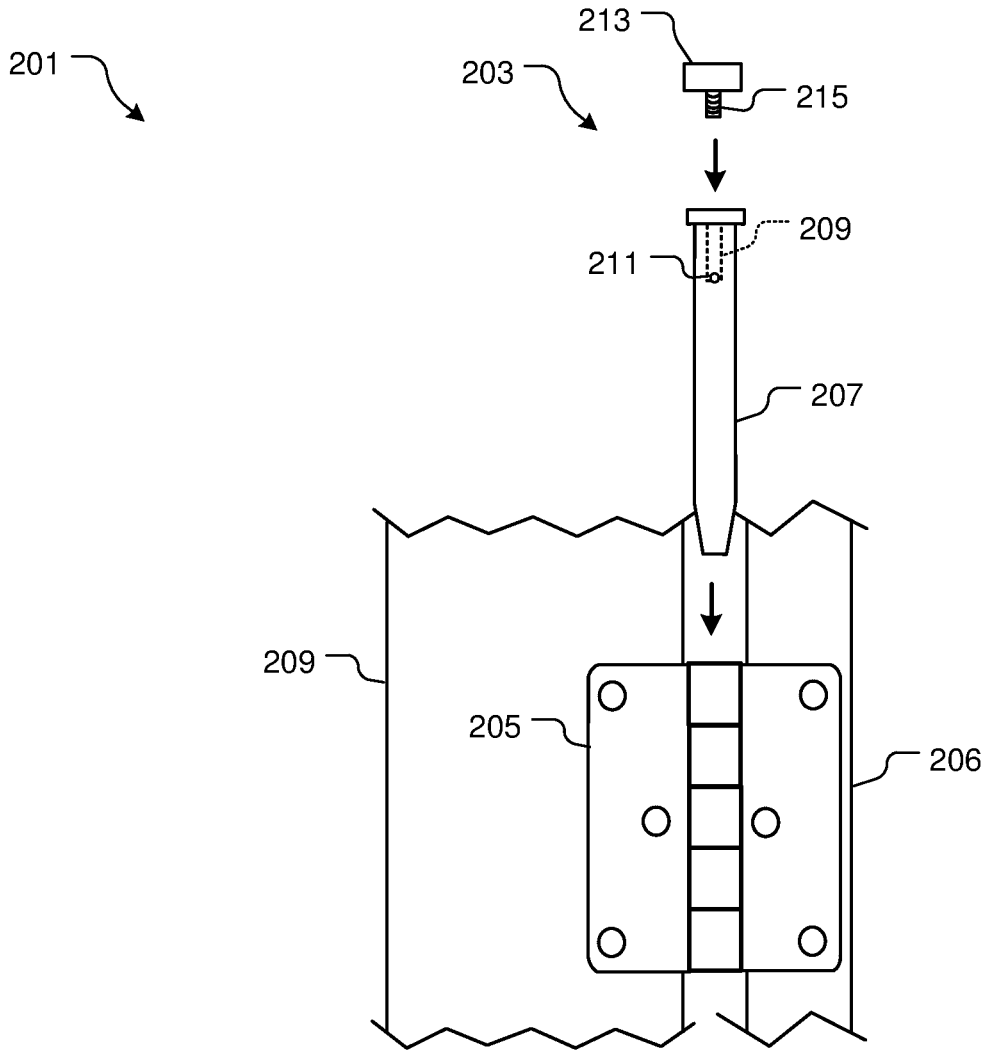
FIGS. 2A and 2B are simplified front views of a hinge system with a hinge pin in accordance with a preferred embodiment of the present application.
Figure 2B:
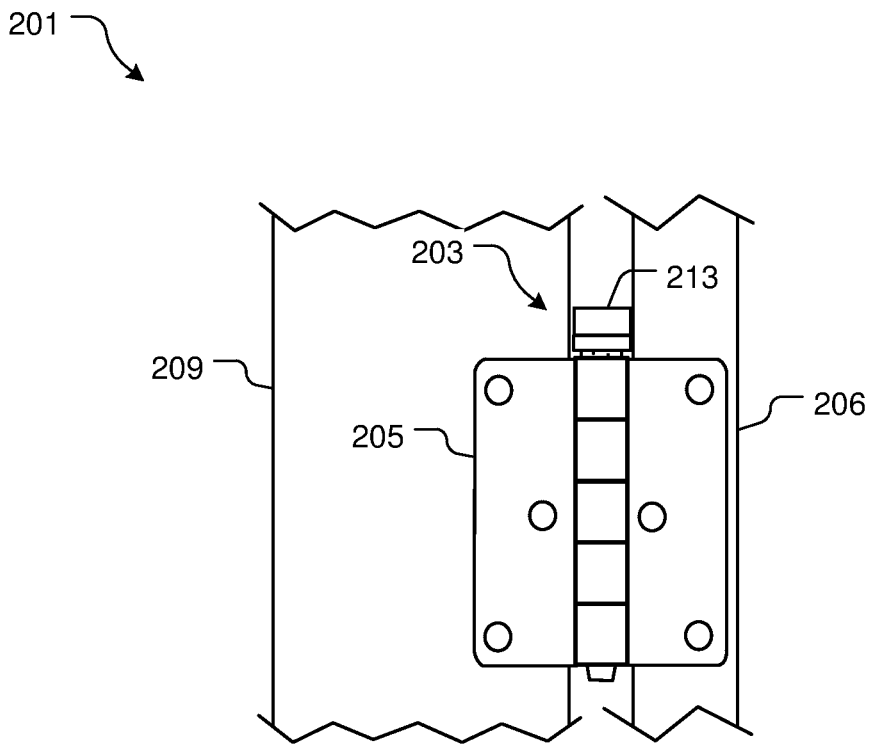

Referring now to the drawings wherein like reference characters identify corresponding or similar elements throughout the several views, FIGS. 2A and 2B depict simplified front views a hinge system 201 with a hinge pin 203 in accordance with a preferred embodiment of the present application. It will be appreciated that hinge pin 203 overcomes one or more of the above-listed problems commonly associated with conventional door hinge systems.

System 201 depicts the use of hinge pin 203 with a door hinge 205 secured to a door 206 and a door frame 209. It should be appreciated that pin 203 can be used with a variety of hinges, including door hinges, cabinet hinges, or any other apparatus having a hinge similar in form and function to hinge 205.

Pin 203 includes a pin body 207 with an internal reservoir 209 disposed therein. Reservoir 209 is configured to receive a lubricant to be dispersed through one or more weep holes 211 extending from the exterior of body 207 to reservoir 209. Pin 203 further includes a cap 213 with a connection device 215, such as a threaded connector, configured to removably engage with a top of body 207.

As shown in FIG. 2B, pin 203 is inserted into hinge 205, wherein cap 213 is easily accessible, thereby allowing for cap 213 to be removed while pin 203 remains secured within hinge 205.

Figures 3A, 3B:
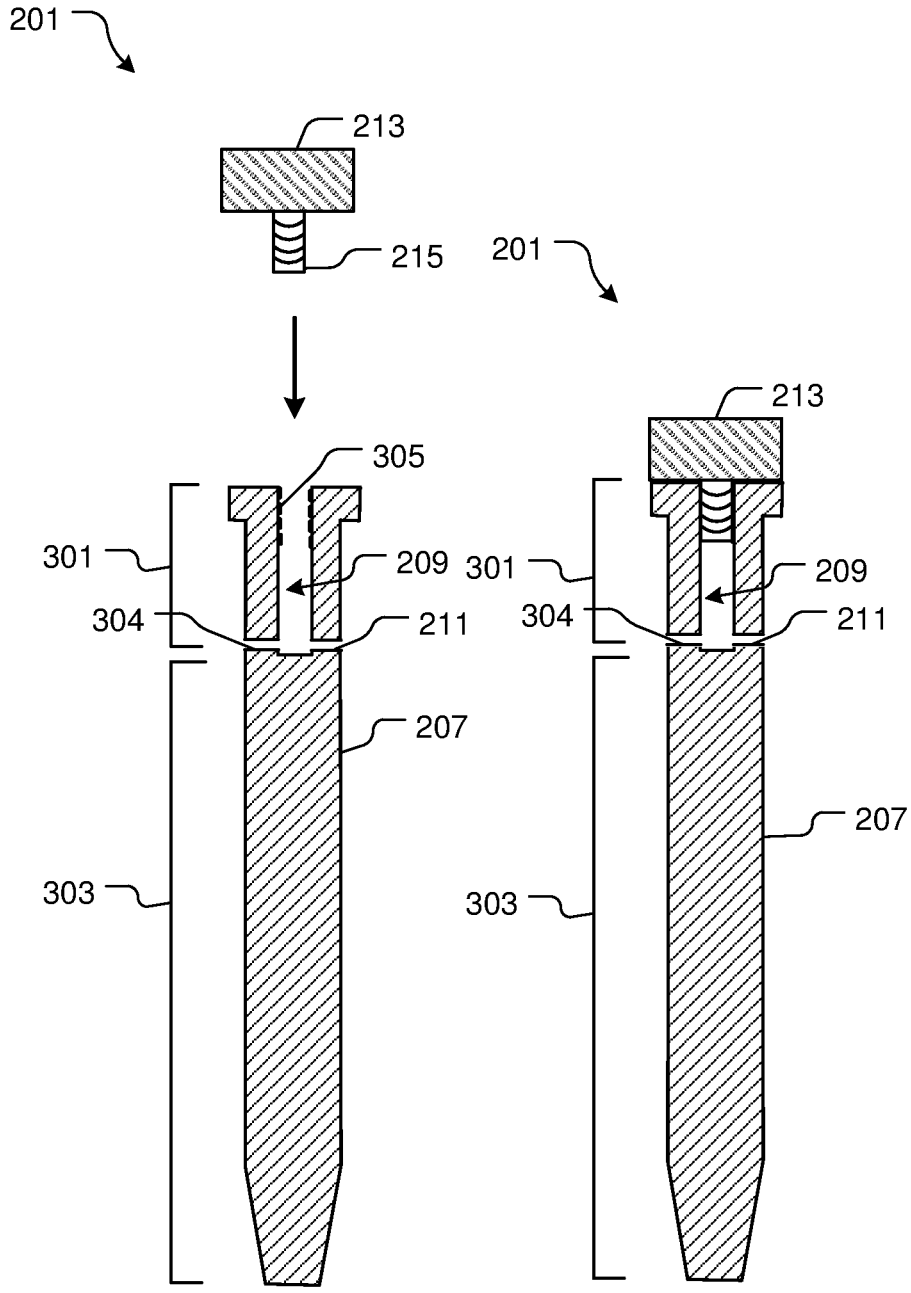
FIGS. 3A and 3B are side cross sectional views of the hinge pin of FIGS. 2A and 2B.

In FIGS. 3A and 3B, side cross sectional views of pin 203 are shown. In the preferred embodiment, pin body 207 has a top portion 301 and a bottom portion 303, wherein the top portion 301 is substantially shorter than bottom portion 303. Reservoir 209 extends the distance of top portion 301, thereby being substantially contained near the top of body 207. In one embodiment, the reservoir extends less than 20% of the length of body 207. In another embodiment, the reservoir extends less than 10% of the length of the body. In the preferred embodiment, weep holes 211, 304 are positioned at the base of reservoir 209, thereby ensuring that lubricant fully exits reservoir 209.

In one embodiment, reservoir 209 includes threads 305 configured to engaged with connection device 215. However, it is contemplated that various connection mechanisms could be incorporated to secure cap 213 to body 207.

Figure 4:
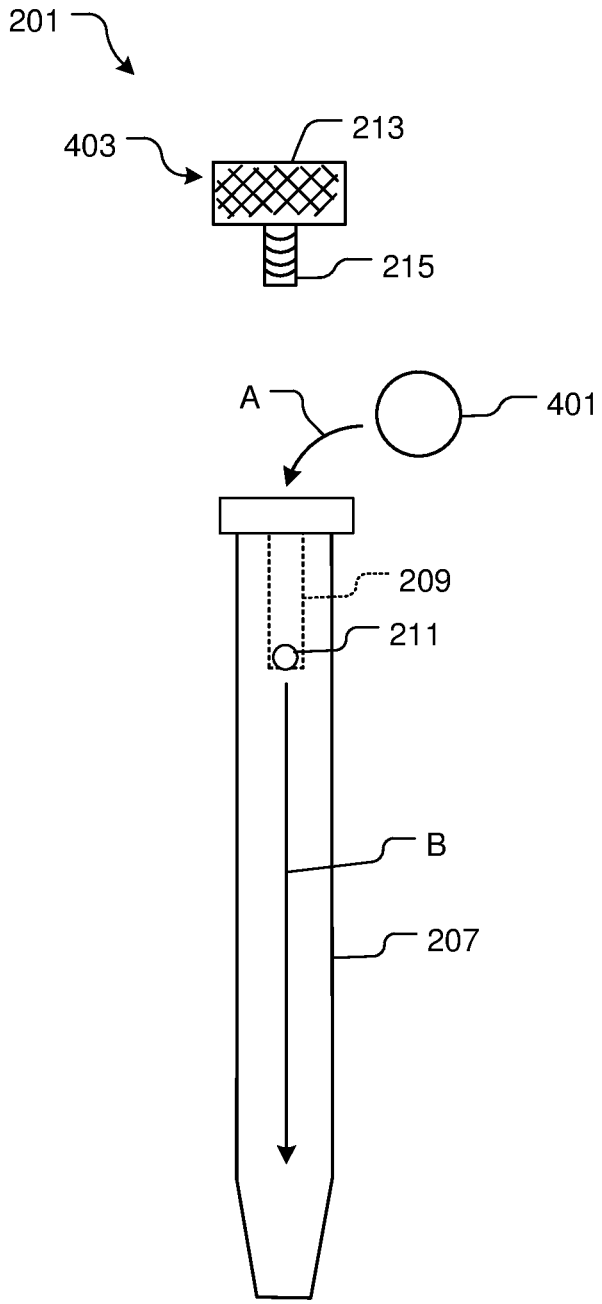
FIG. 4 is a front view of the hinge pin of FIGS. 2A and 2B demonstrating lubrication flow.

In FIG. 4, a front view of pin 203 receiving a lubricant 401 is shown. Lubricant 401 is inserted into reservoir 209 through the top of body 207, as demonstrated with arrow A. Lubricant 401 immediately begins exiting through weep hole 211 and traveling down body 207, as shown with arrow B. It should be appreciated that lubricant thereby coats the majority of the exterior of body 207. In one embodiment, weep hole 211 has a diameter sized appropriately to allow a volume of lubricant held by reservoir 209 to fully disperse within 1 minute. In another embodiment, hole 211 has a diameter sized appropriately to allow the lubricant to disperse within 30 seconds. As further shown in FIG. 4, it is contemplated that cap 213 can include a textured exterior surface 403, thereby providing a grip for easier removal of cap 213.

It should be appreciated that one of the unique features believed characteristic of the present application is the positioning of a weep hole 211 at the base of a shallow reservoir positioned at the top of a pin body. It should be appreciated that this configuration allows for the lubricant to completely disperse at the top of pin 203, thereby coating the majority of the pin.

Figure 5:
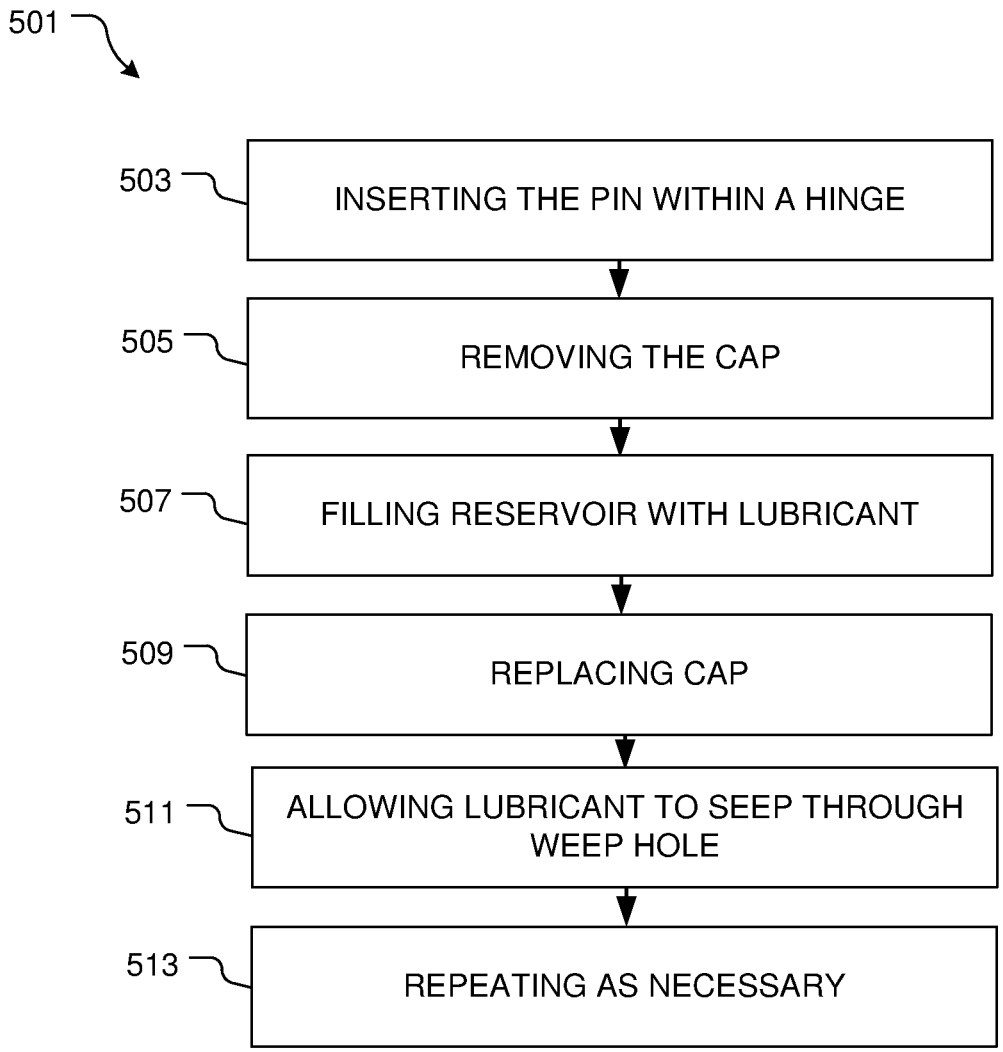
FIG. 5 is a flowchart of the method of FIGS. 2A and 2B.

In FIG. 5, a flowchart 501 depicts a method of use of FIGS. 2A and 2B. During use, the hinge pin is inserted within a hinge, as shown with box 503. As necessary for lubrication, the cap is removed and the reservoir is filled with a lubricant, as shown with boxes 505, 507. The cap is replaced and the lubricant is allowed to disperse through the weep hole, as shown with boxes 509, 511. As necessary over time, the process is repeated to ensure the hinge system is adequately lubricated, as shown with box 513.

The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed is:

1. A hinge pin, comprising:

a pin body with an upper portion and a lower portion;

a reservoir within the pin body and accessible from a top end of the body, the reservoir extending a length of the upper portion;

a weep hole extending from an outer surface of the upper portion of the pin body and into the reservoir, the weep hole is positioned at a base of the reservoir; and a cap configured to removably secure to the pin body at the top end of the body;

wherein the upper portion has a first diameter and the lower portion has a second diameter, the first diameter of the upper portion is greater than the second diameter of the lower portion; and wherein the reservoir is configured to receive a lubricant to disperse through the weep hole.

2. The hinge pin of claim 1, wherein the upper portion extends 20% or less of a length of the pin body.

3. The hinge pin of claim 1, wherein the upper portion extends 10% or less of a length of the pin body.

4. The hinge pin of claim 1, wherein the weep hole has a diameter sized appropriately to allow a volume of lubricant held by the reservoir to completely disperse within 1 minute.

5. The hinge pin of claim 1, wherein the weep hole has a diameter sized appropriately to allow a volume of lubricant held by the reservoir to completely disperse within 30 seconds.

6. The hinge pin of claim 1, wherein the upper portion has a threaded opening for engaging with a threaded connector of the cap.

7. The hinge pin of claim 1, further comprising:

a second weep hole extending from the exterior of the pin body and into the reservoir at the base of the reservoir.

8. A method of lubricating a hinge, the method comprising:

providing the hinge pin of claim 2;

securing the hinge pin within a hinge, wherein the exterior of the hinge pin is in contact with elements of the hinge;

removing the cap from the top of the pin body;

filling the reservoir with the lubricant;

securing the cap to the top of the pin body; and allowing the lubricant to seep from the weep hole to lubricate the exterior surface of the hinge pin and the elements of the hinge.

9. The method of claim 8, further comprising:

waiting a period of time;

removing the cap for a second time from the top of the pin body;

filling the reservoir with the lubricant; and allowing the lubricant to seep from the weep hole to lubricate the exterior surface of the hinge pin and the elements of the hinge for a second time.

* * * * *